US007001186B1

(12) United States Patent
Chen

(10) Patent No.: US 7,001,186 B1
(45) Date of Patent: Feb. 21, 2006

(54) JIG FOR ORIENTATING A CPU

(75) Inventor: Wan-Tien Chen, Taipei (TW)

(73) Assignee: Egbon Electronics LTD, Taipei (TW)

( * ) Notice: Subject to any disclaimer, the term of this patent is extended or adjusted under 35 U.S.C. 154(b) by 0 days.

(21) Appl. No.: 11/161,256

(22) Filed: Jul. 28, 2005

(51) Int. Cl.
*H01R 12/00* (2006.01)

(52) U.S. Cl. ..... 439/73; 439/331; 439/923

(58) Field of Classification Search ..... 439/73, 439/331, 923

See application file for complete search history.

(56) References Cited

U.S. PATENT DOCUMENTS 6,927,981 B1 * 8/2005 Kao ..... 439/73

* cited by examiner

*Primary Examiner*—Tho D. Ta
(74) *Attorney, Agent, or Firm*—Jiang Chyun IP Office

(57) ABSTRACT

A jig for precisely orientating a CPU over a socket of a connector comprises a frame, a limiting portion, an elastic portion and a positioning portion. The frame has an opening. The limiting portion and the elastic portion are formed on the frame. When the CPU is received in the opening, the limiting portion contacts a non-contact surface of the CPU, and the elastic portion presses the sides of the CPU. The positioning portion is formed on the frame and limits the movement of the frame relative to the socket when the CPU is received in the opening and the frame is put on the socket. Therefore, the CPU is precisely positioned over a transmission section of the socket, and a contact surface of the CPU contacts the transmission section of the socket.

9 Claims, 10 Drawing Sheets

JIG FOR ORIENTATING A CPU

CROSS-REFERENCE TO RELATED APPLICATION

This application claims the priority benefit of Taiwan application serial no. 94200235, filed on Jan. 6, 2005. All disclosure of the Taiwan application is incorporated herein by reference.

BACKGROUND OF THE INVENTION

1. Field of the Invention

The present invention relates to a jig for orientation, and more particularly, to a jig for orientation that can prevent terminals from being touched by a user's fingers during assembly.

2. Description of the Related Art

Along with the continuous progress of electronic technology, the electronic products are widely used in our daily life now; and the appearance of the computer had greatly impacted our work and daily life. In order to improve the computer performance and to fulfill users' requirements, various parts used in the computer have been continuously developed. Regarding to the CPU (Central Processing Unit) used in the computer, since its cost is rather high, during the process of integrating a sound chip, a graphics chip, and a network chip on a motherboard of a computer, the CPU is installed on the motherboard by a detachable method. In other words, a connector for connecting the CPU is configured on the motherboard, thus the CPU with the same specification can be installed on it.

Since the operating speed and performance of the CPU are continuously improved, the number of the terminals of the CPU is also gradually increased. Under the situation of continuously increasing the number of the terminals, the conventional CPU package substrate using the PGA (pin grid array) as the signal transmission interface cannot meet the requirements any more. Therefore, a new CPU package substrate using the LGA (land grid array) as the signal transmission interface has been developed now. The CPU using the LGA substrate is electrically coupled to the motherboard via a connector having the same LGA specification on the motherboard. The contact points used by the LGA type CPU are a plurality of pad terminals arranged in an area array on the bottom of the LGA substrate, and the conventional pin terminals used by the PGA type CPU are replaced by the elastic-slice terminals in the socket of the connector corresponding to the LGA specification. When the LGA type CPU is installed on a connector with the LGA specification, one end of each elastic-slice terminal is correspondingly contacted with a pad terminal on the bottom of the LGA substrate.

FIGS. 1A and 1B schematically show a 3D disassembly diagram and a 3D assembly diagram of an LGA type CPU and an LGA type connector, respectively. A CPU 10 comprises a chip (not shown), a substrate 12 and a heat dissipation cover 14. The chip is adhered to a non-contact surface 12*b* of the substrate 12 with a flip-chip bonding technique, and covered by the heat dissipation cover 14. A plurality of pad terminals (not shown) is distributed on a contact surface 12*a* of the substrate 12. In addition, each of two opposite sides of the substrate 12 has a fool-pro indentation 13, and the fool-pro indentations 13 are corresponded to two fool-pro protrusions 23 formed in a socket 20 of an LGA type connector, respectively. Therefore, when the substrate 12 of the CPU 10 is manually installed on a transmission section 22 (e.g. a cavity) of the socket 20, two fool-pro indentations 13 of the substrate 12 are exactly inset into these two fool-pro protrusions 23 of the socket 20, respectively, such that the possibility of erroneously assembling the CPU 10 is significantly reduced. The socket 20 mentioned above is configured inside a bottom cover 24 of a connector jig.

Since several hundreds of elastic terminals (not shown) are contained within an area of about 10 $cm^2$ inside the socket 20 of the LGA type connector, the structure of these elastic terminals is exquisite and fragile that it is easily to be deformed by external force. Therefore, when the elastic terminals in the socket 20 are deformed due to the improper external force, the connector may not be able electrically coupling to the CPU 10, and a motherboard having the connector 20 will not be normally operated any more. The situation mentioned above usually happens during the procedure when a user manually puts the substrate 12 of the CPU 10 onto the transmission section 22 of the socket 20. In such case, the elastic terminals are deformed by the improper external force applied onto the elastic terminals by the user's fingers.

SUMMARY OF THE INVENTION

Therefore, it is an object of the present invention to provide a jig for orientating a CPU for preventing a user's fingers from touching elastic terminals on a transmission section of a socket when the CPU is being orientated on the transmission section of the socket in a connector.

It is another object of the present invention to provide a jig for orientating a CPU for precisely orientating a CPU right above a transmission section of a socket in a connector, such that the CPU can be precisely pushed onto the transmission section of the socket manually.

In order to achieve the objects mentioned above, the present invention provides a jig for orientating a CPU right above a transmission section of a socket in a connector. The CPU comprises a contact surface and a corresponding non-contact surface, and the CPU is orientated on the transmission section of the socket with the contact surface. The jig for orientating a CPU comprises a frame, a limiting portion, an elastic portion, and a positioning portion. The frame has an opening for receiving the CPU. The limiting portion is formed on the frame. When the CPU is received in the opening, the limiting portion is contacted with the non-contact surface of the CPU. The elastic portion is formed on the frame, and when the CPU is received in the opening, the elastic portion presses the sides of the CPU. The positioning portion is formed on the frame. When the CPU is received in the opening and the frame is put on the socket, the positioning portion limits the movement of the frame relative to the socket, such that the CPU is disposed right above the transmission section, and the contact surface of the CPU is exactly faced to the transmission section.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

Figure 1A:
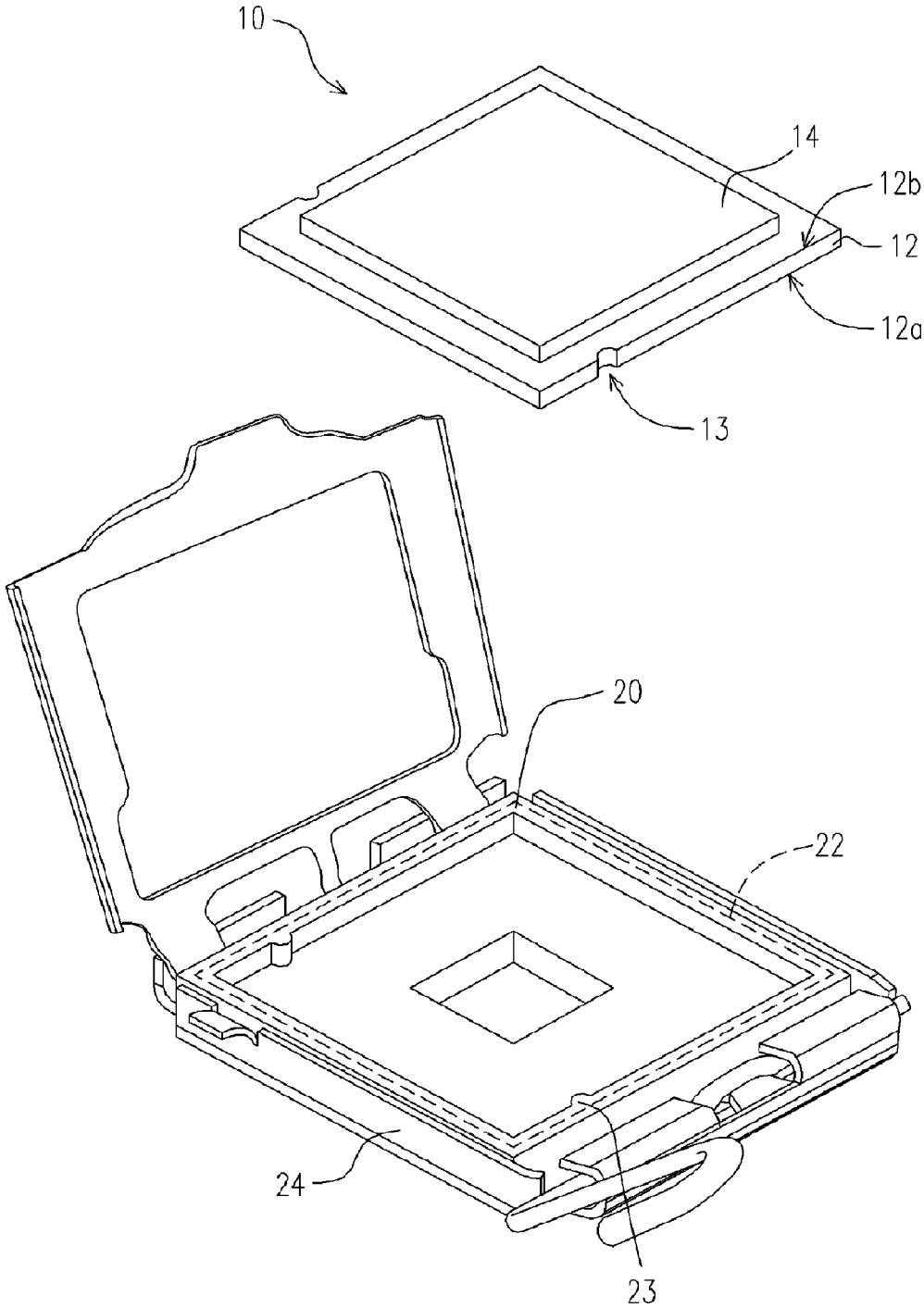
FIG. 1A (PRIOR ART)
FIGS. 1A and 1B schematically show a 3D disassembly diagram and a 3D assembly diagram of an LGA type CPU and an LGA type connector, respectively.
Figure 1B:
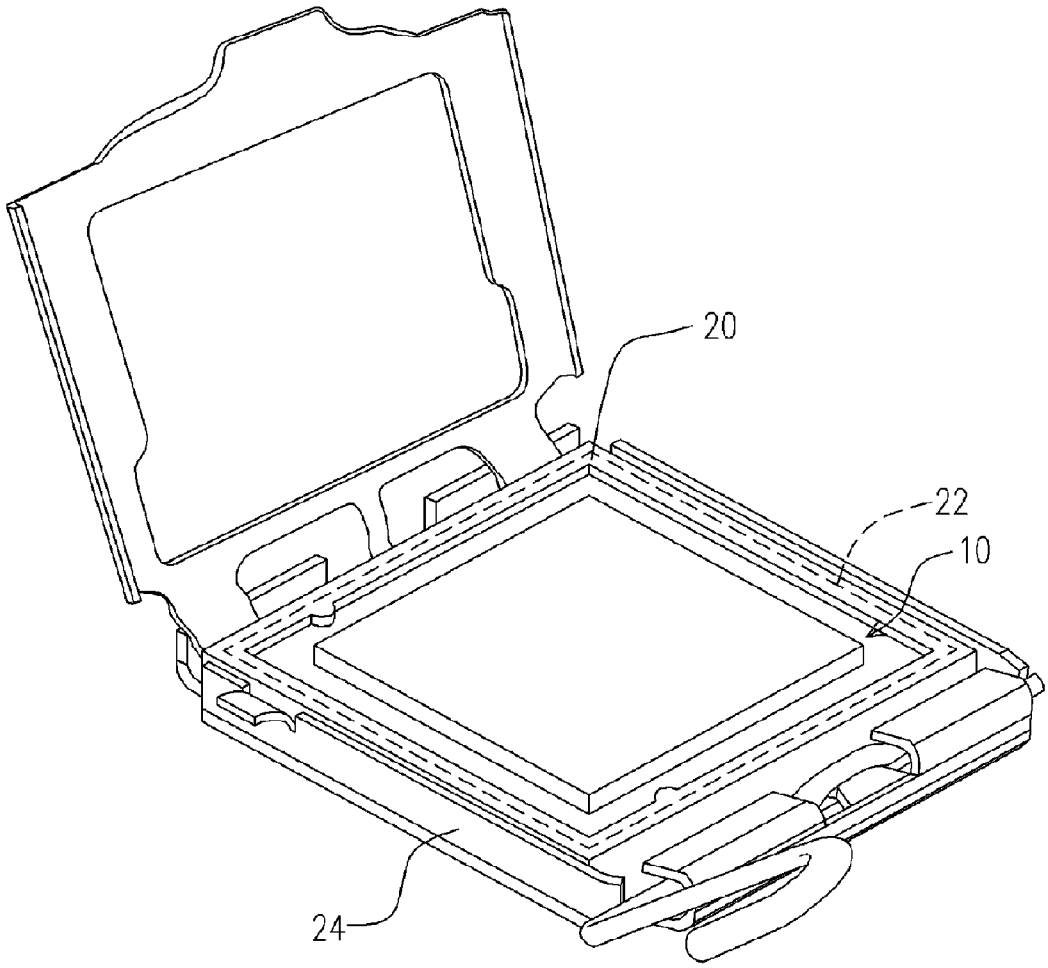
FIG. 1B (PRIOR ART)
Figure 2A:
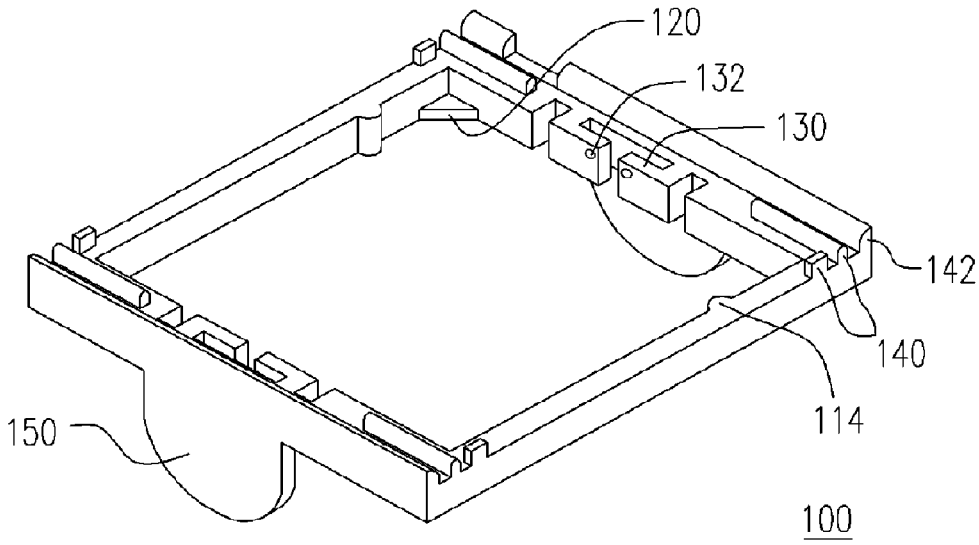
FIGS. 2A and 2B schematically show a 3D top view diagram and a 3D bottom view diagram of a jig for orientating a CPU according to a first embodiment of the present invention, respectively.
Figure 2B:
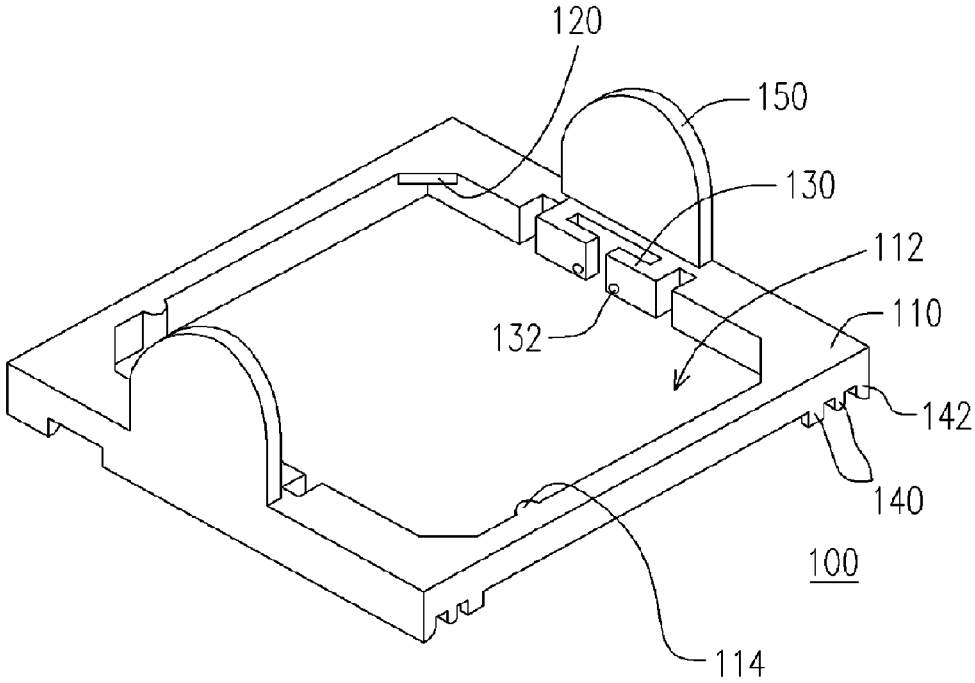

Referring to FIGS. 1A, 2A, and 2B, wherein FIGS. 2A and 2B schematically show a 3D top view diagram and a 3D bottom view diagram of a jig for orientating a CPU according to a first embodiment of the present invention, respectively. A jig 100 for orientating a CPU (abbreviated as jig hereinafter) comprises a frame 110, a plurality of limiting portions 120, a plurality of elastic portions 130 and a plurality of positioning portions 140. The frame 110 has an opening 112. The shape of the opening 112 is substantially corresponded to the shape of the substrate 12 of the CPU 10 in FIG. 1A, and the opening 112 is suitable for receiving the substrate 12. In addition, the limiting portions 120 are formed on the frame 110 and extended from the inner wall of the opening 112 toward the center of the opening 112. When the substrate 12 is received in the opening 112, the limiting portions 120 are contacted with the non-contact surface 12*b* of the substrate 12 so as to limit a one-dimension linear movement of the substrate 12 relative to the frame 110. In the first embodiment of the present invention, the limiting portions 120 are distributed on four corners of the opening 112 with a flat construction.

In the first embodiment of the present invention, the elastic portions 130 are L-shape elastic slices formed on the frame 110 and substantially disposed inside the opening 112. A first end of the elastic portions 130 is formed on the inner wall of the opening 112, and a second end of the elastic portions 130 is extended from the inner wall of the opening 112, such that an elastic contact end is formed. When the substrate 12 is received in the opening 112, the elastic portions 130 press the sides of the substrate 12. Particularly, each of the elastic portions 130 further comprises a limiting-protrusion 132 extruded from the surface of the second end thereof. In addition, the distance between the limiting-protrusion 132 and the limiting portion 120 is substantially equal to the thickness of the substrate 12. Therefore, when the substrate 12 is received in the opening 112, the substrate 12 of the CPU is orientated in the opening 112 of the frame 110 by the limiting-protrusions 132 and the limiting portions 120, such that the substrate 12 is not easily detached from the opening 112.

The positioning portions 140 are formed on the frame 110. When the substrate 12 of the CPU 10 is received in the opening 112 and the frame 10 is put on the socket 20 of the connector in FIG. 1A, the positioning portions 140 are contacted with the periphery of the socket 20 to limit the movement of the frame 110 relative to the socket 20. Accordingly, the substrate 12 is precisely disposed right above the transmission section 22 (e.g. a cavity) of the socket 20, and the contact surface 12*a* of the substrate 12 is exactly faced to the transmission section 22 of the socket 20. In addition, if each of two opposite sides in the substrate 12 of the CPU 10 has a fool-pro indentation 13, the jig 100 further comprises two fool-pro protrusions 114. When the substrate 12 is received in the opening 112, the fool-pro protrusions 114 are exactly inset into the fool-pro indentations 13 on the substrate 12, respectively. In addition, in order to facilitate a user manually moving the jig 100, the jig 100 further comprises two handling portions 150, such that the user can use his fingers to handle it. In addition, all components to build up the jig 100 may be integrated as one unit, such that the manufacturing cost of the jig 100 is reduced.

Especially when other elements are disposed by the socket 20, in order to increase the stability of orientating the substrate 12 of the CPU 10 on the socket 20, the size of the frame 110 and the amount of the positioning portions 140 may be both increased. For example, when the socket 20 of the connector is inside the bottom cover 24 of the connector jig in FIG. 1A, and two corresponding side walls of the bottom cover 24 are vertically extended to both sides of the socket 20 respectively, the jig 100 further comprises two auxiliary positioning portions 142 coupled to the surface of the frame 10. When the substrate 12 is received in the opening 112 and the frame 110 is put on the socket 20 of the connector in FIG. 1A, the auxiliary positioning portions 142 are contacted with the two side walls of the bottom cover 24 to limit the movement of the frame 110 relative to the bottom cover 24. Accordingly, the substrate 12 is firmly disposed right above the transmission section 22 of the socket 20.

Figure 3A:
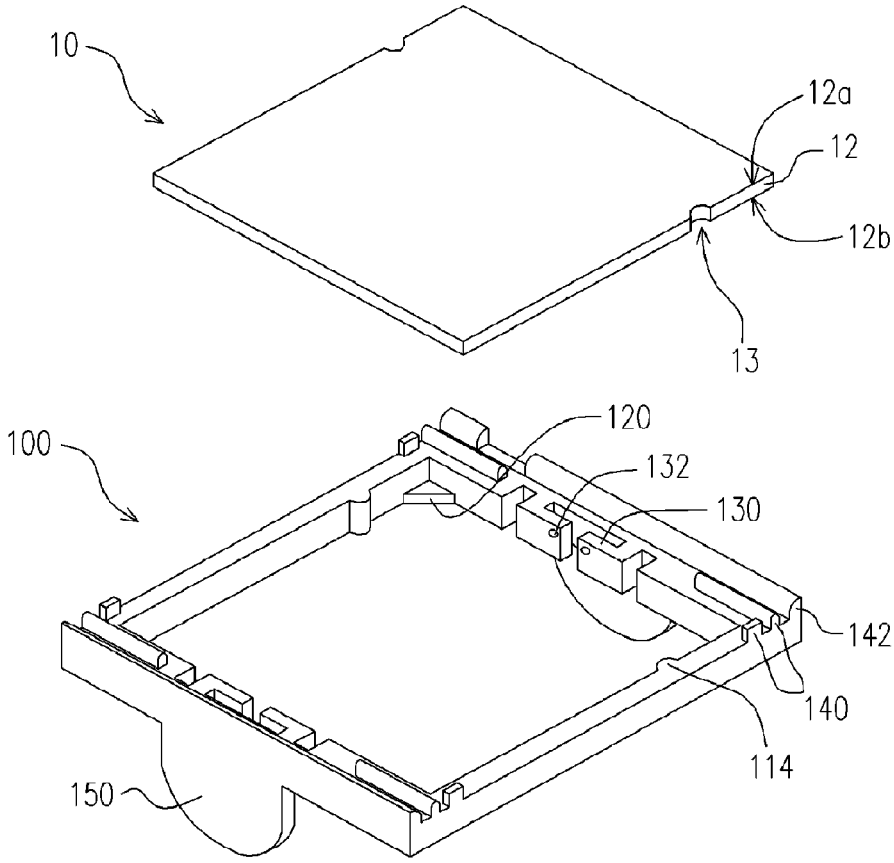
FIGS. 3A~3E schematically show a case of applying the jig of FIGS. 2A and 2B to assemble the CPU onto the connector shown in FIG. 1A.
Figure 3B:
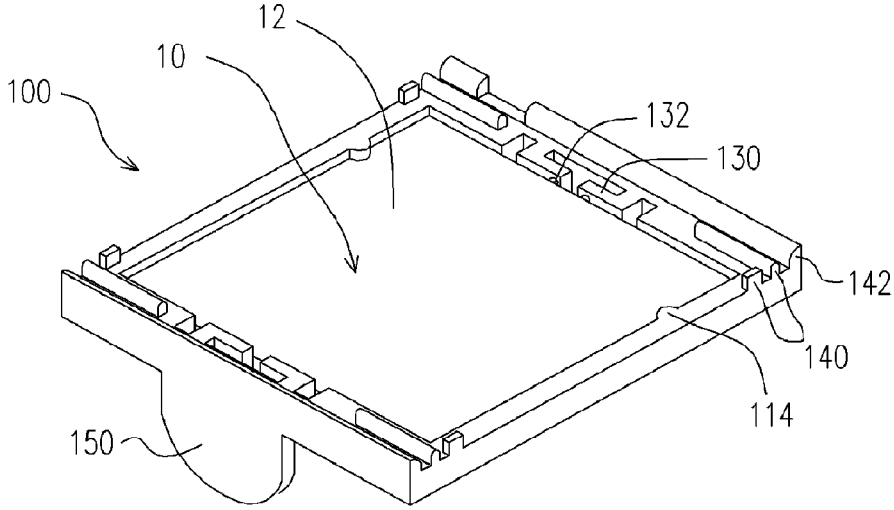

FIGS. 3A~3E schematically show a case of applying the jig of FIGS. 2A and 2B to assemble the CPU onto the connector shown in FIG. 1A. As shown in FIGS. 3A and 3B, the substrate 12 is inset into the opening 112 with the non-contact surface 12*b* of the substrate 12 of the CPU 10 in a direction toward the opening 112 of the frame 110. After the substrate 12 is manually inset into the opening 112, the elastic portions 130 press the sides of the substrate 12 to push the substrate 12 into the opening 112. The substrate 12 is orientated to the opening 112 of the frame 110 by the limiting-protrusions 132 and the limiting portions 120 (as shown in FIG. 3A), such that the substrate 12 is not easily detached from the opening 112.

Figure 3C:
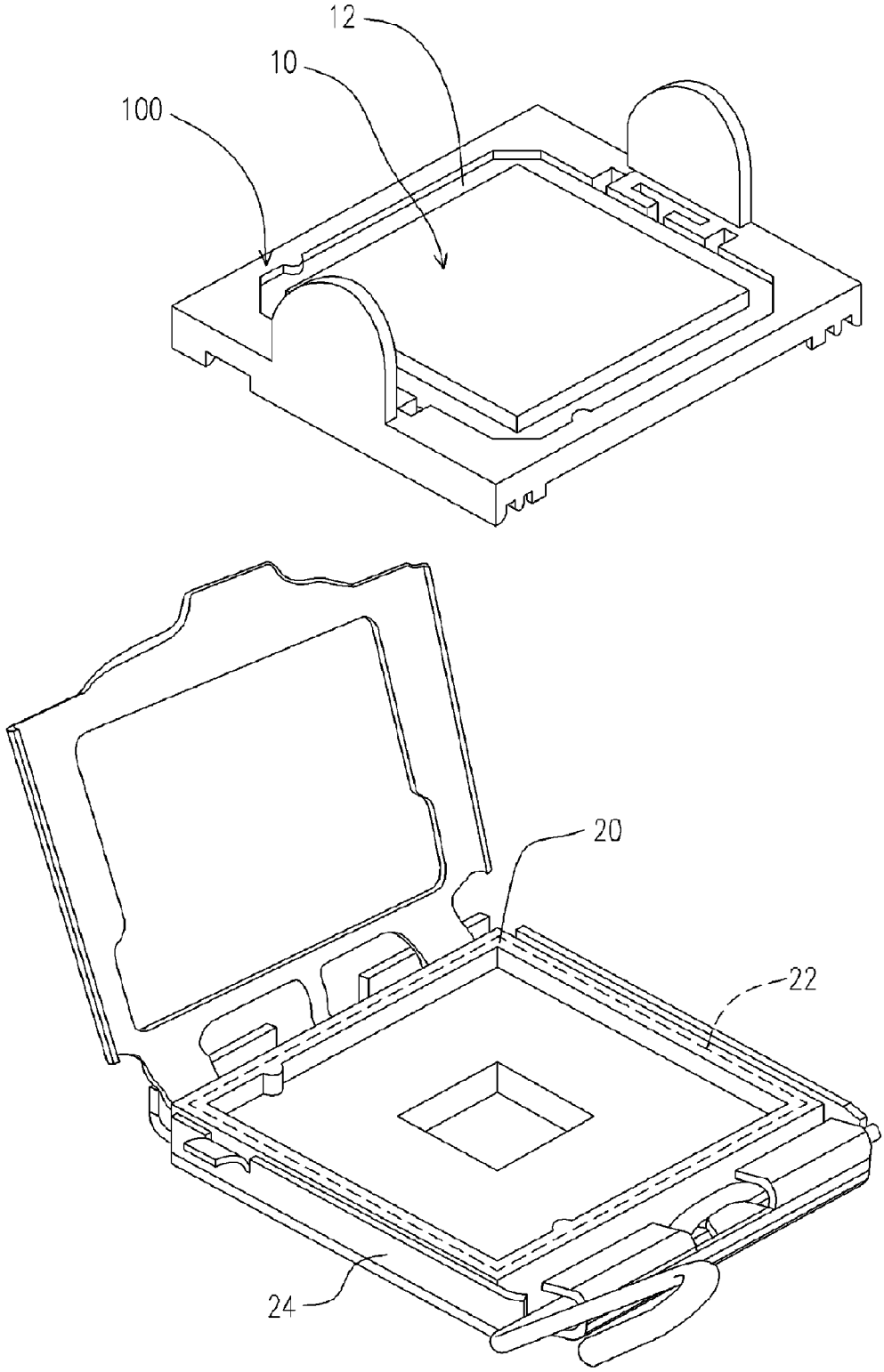
Figure 3D:
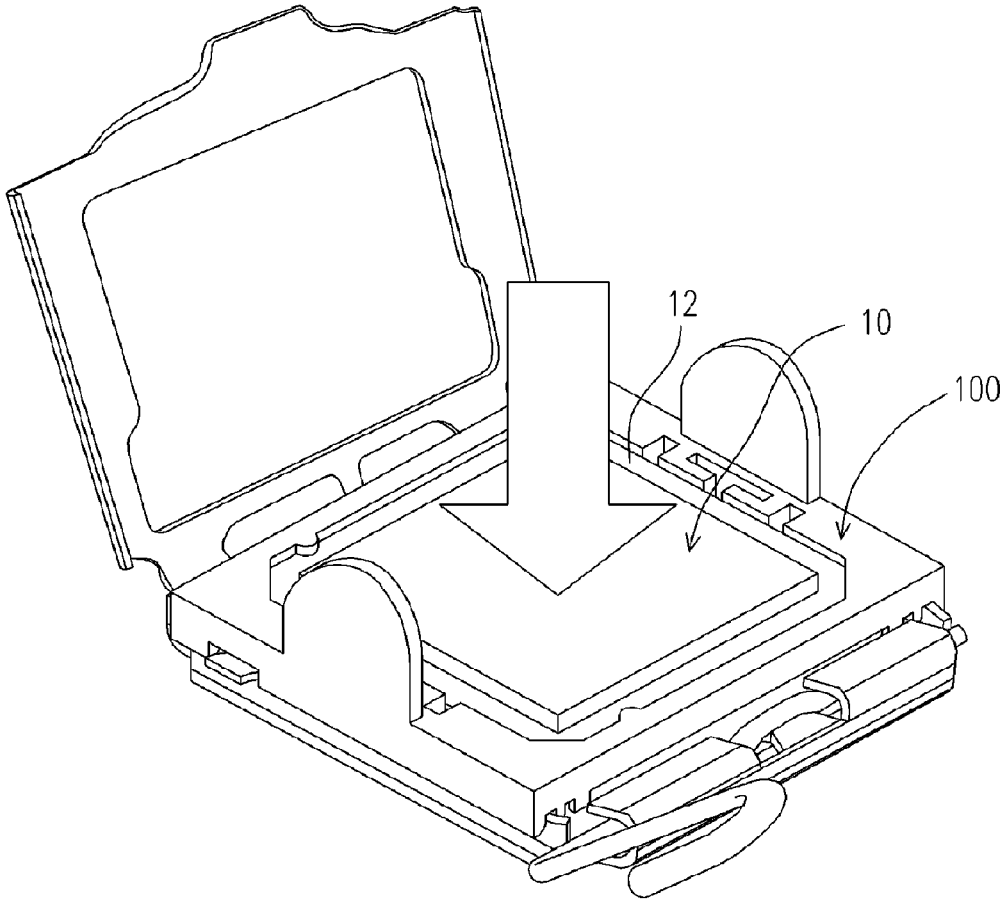
Figure 4A:
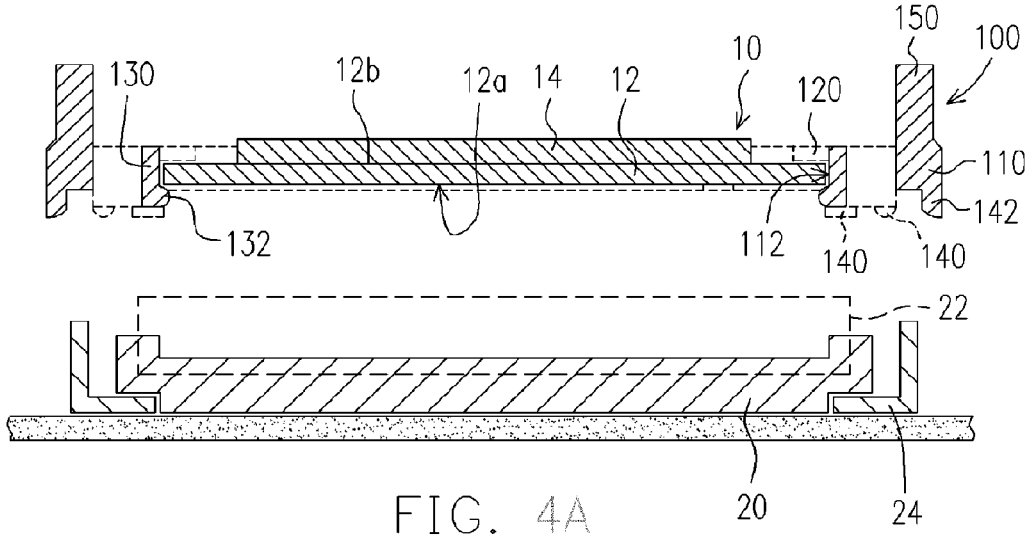
FIG. 4A is a cross-sectional diagram of FIG. 3C.
Figure 4B:
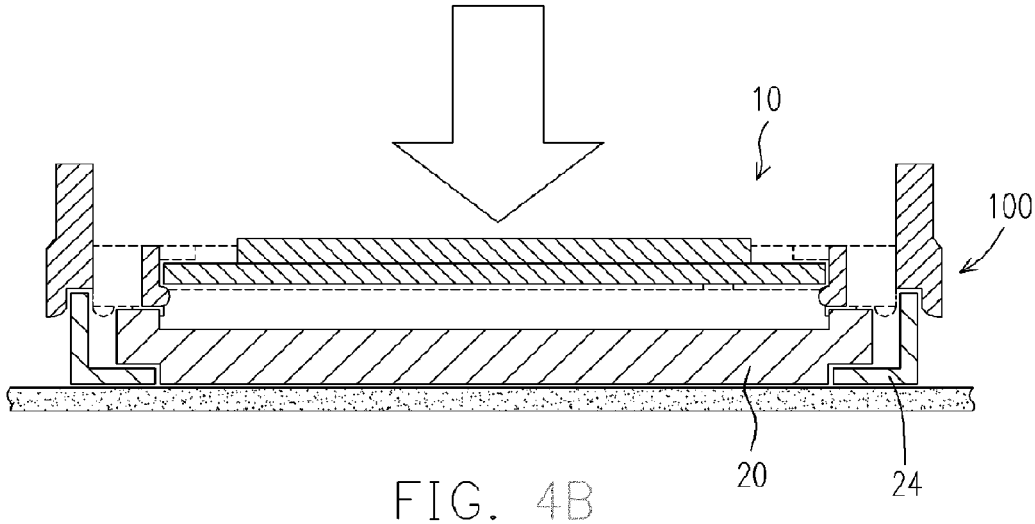
FIG. 4B is a cross-sectional diagram of FIG. 3D.

As shown in FIGS. 3C, 3D and FIGS. 4A, 4B, wherein FIGS. 4A and 4B are the cross-sectional diagrams of FIGS. 3C and 3D, respectively. A user uses his fingers to hold the handling portions 150 in order to move and put the jig 100 and the CPU 10 onto the socket 20. The positioning portions 140 in FIG. 3A are contacted with the periphery of the socket 20 to limit the movement of the frame 110 relative to the socket 20. In addition, the auxiliary positioning portions 142 in FIG. 3A are contacted with the side walls of the bottom cover 24 to limit the movement of the frame 110 relative to the bottom cover 24. Accordingly, the substrate 12 is disposed right above the transmission section 22 of the socket 20, and the contact surface 12*a* of the substrate 12 is exactly faced to the transmission section 22 of the socket 20.

Figure 3E:
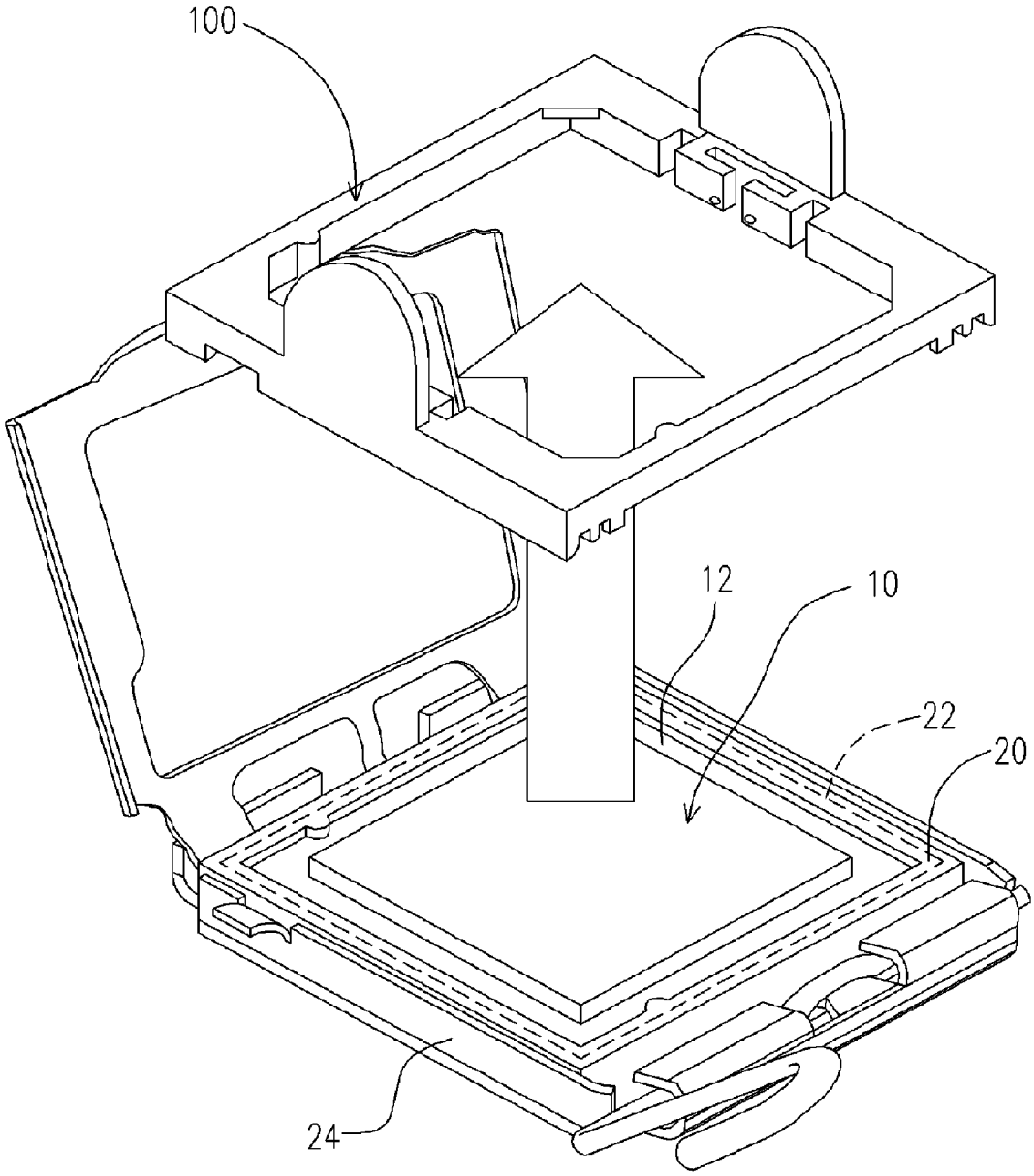
Figure 4C:
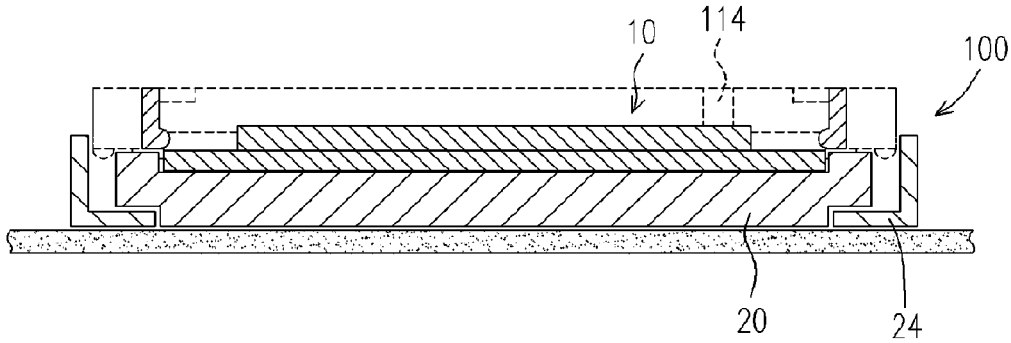
FIG. 4C is a cross-sectional diagram of FIG. 3E.

Next, as shown in FIGS. 3E and 4C, wherein FIG. 4C is a cross-sectional diagram of FIG. 3E. The CPU 10 is manually pressed in a direction indicated by the arrow shown in FIG. 3D, such that the substrate 12 of the CPU 10 is precisely pushed onto the transmission section 22 of the socket 20, and is detached from the limiting-protrusions 132 and the limiting portions 120 in FIG. 3A. After the user uses his fingers to hold the handling portions 150 and moves the jig 100 upward, finally the substrate 12 of the CPU 10 is precisely disposed in the transmission section 22 of the socket 20.

Figure 5A:
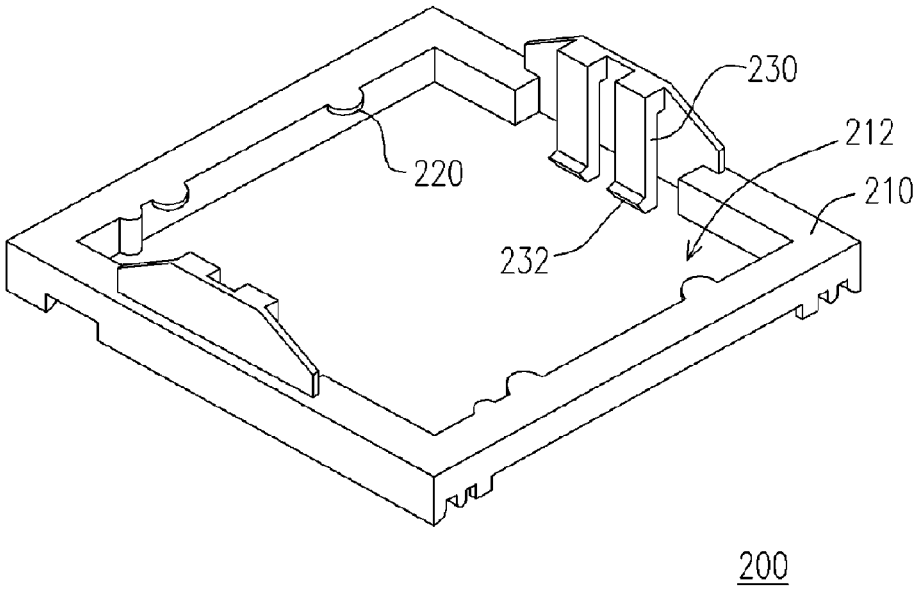
FIGS. 5A and 5B schematically show a 3D top view diagram and a 3D bottom view diagram of a jig for orientating a CPU according to a second embodiment of the present invention, respectively.
Figure 5B:
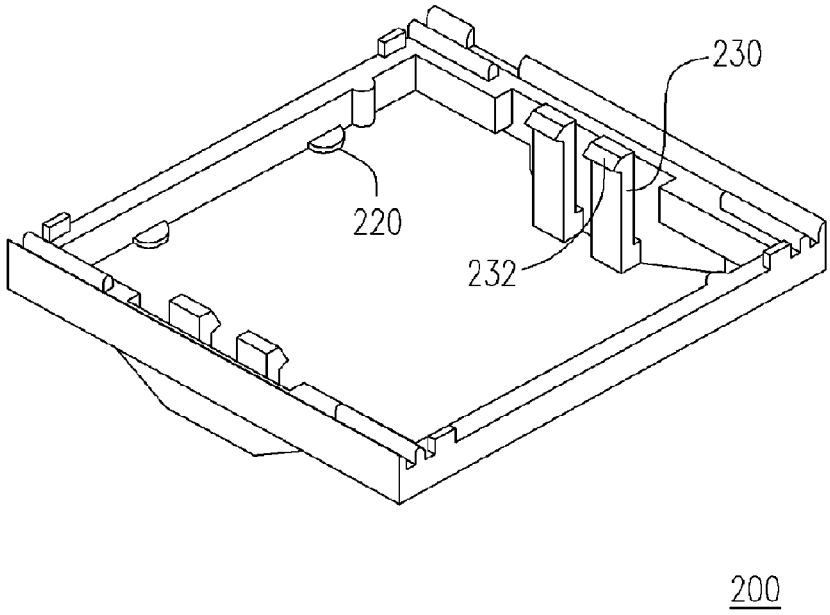

FIGS. 5A and 5B schematically show a 3D top view diagram and a 3D bottom view diagram of a jig for orientating a CPU according to a second embodiment of the present invention, respectively. Comparing with the position of the limiting portions 120 of the jig 100 in the first embodiment, the plurality of limiting portions 220 of the jig 200 in the second embodiment are extruded from both sides of the opening 212 in the frame 210, the elastic portions 230 are changed to U-shaped elastic slices, and the limiting-protrusions 232 are changed to linear shape. In addition, the operation of the jig 200 in the second embodiment is similar to the operation of the jig 100 in the first embodiment, thus its detail is omitted herein.

Figure 6A:
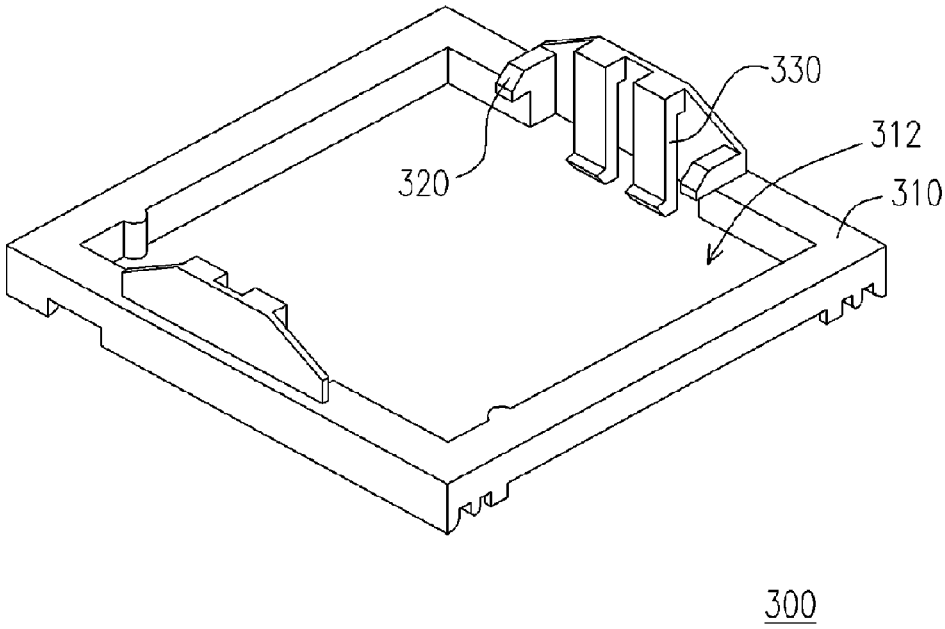
FIGS. 6A and 6B schematically show a 3D top view diagram and a 3D bottom view diagram of a jig for orientating a CPU according to a third embodiment of the present invention, respectively.
Figure 6B:
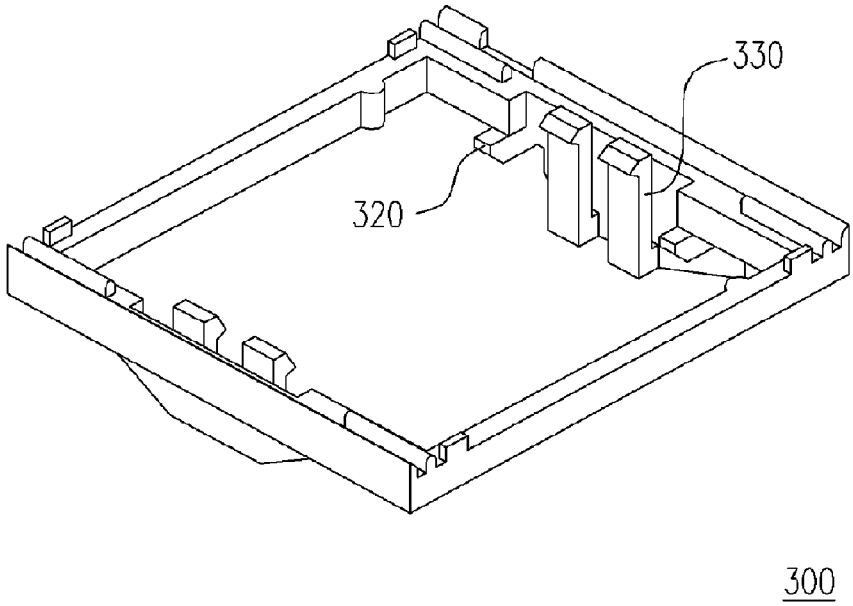

FIGS. 6A and 6B schematically show a 3D top view diagram and a 3D bottom view diagram of a jig for orientating a CPU according to a third embodiment of the present invention, respectively. Comparing with the position of the limiting portions 220 of the jig 200 in the second embodiment, the plurality of limiting portions 320 of the jig 300 in the third embodiment are also extruded from both sides of the opening 312 in the frame 310 but disposed by the side of the elastic portions 330. In addition, the operation of the jig 300 in the third embodiment is similar to the operation of the jig 100 in the first embodiment, thus its detail is omitted herein.

Although the invention has been described with reference to the particular embodiments thereof, it will be apparent to one of the ordinary skill in the art that modifications to the described embodiments may be made without departing from the spirit of the invention. Accordingly, the scope of the invention will be defined by the attached claims not by the above detailed description.

What is claimed is:

1. A jig for orientating a CPU suitable for orientating a CPU right above a transmission section of a socket in a connector, wherein the CPU comprises a contact surface and a corresponding non-contact surface, the CPU is orientated on the transmission section of the socket with the contact surface, and the jig comprises:

a frame having an opening for receiving the CPU;

a limiting portion formed on the frame, and when the CPU is received in the opening, the limiting portion is contacted with the non-contact surface of the CPU;

an elastic portion formed on the frame, and when the CPU is received in the opening, the elastic portion presses a side of the CPU; and a positioning portion formed on the frame, and when the CPU is received in the opening and the frame is put on the socket, the positioning portion limits a movement of the frame relative to the socket, such that the CPU is precisely disposed right above the transmission section, and the contact surface of the CPU is exactly faced to the transmission section.

2. The jig for orientating a CPU of claim 1, further comprising a handling portion coupled to the frame, such that a user can hold it with hand.

3. The jig for orientating a CPU of claim 1, wherein the limiting portion is extended from an inner wall of the opening toward the center of the opening.

4. The jig for orientating a CPU of claim 1, further comprising a fool-pro protrusion, and when the CPU is received in the opening, the fool-pro protrusion is exactly inset into at least one fool-pro indentation at the edge of the CPU.

5. The jig for orientating a CPU of claim 1, further comprising an auxiliary positioning portion formed on the frame, and the connector further comprising a bottom cover disposed inside the socket, wherein when the CPU is received in the opening and the frame is put on the socket, the auxiliary positioning portion limits a movement of the frame relative to the bottom cover.

6. The jig for orientating a CPU of claim 1, wherein the elastic portion is an L-shaped elastic slice, a first end of the elastic portion is formed on the inner wall of the opening, and a second end of the elastic portion is extended from the inner wall of the opening.

7. The jig for orientating a CPU of claim 6, wherein the elastic portion comprises a limiting-protrusion extruded from a surface of the second end of the elastic portion, and a distance between the limiting-protrusion and the limiting portion is greater than or equal to a thickness of the edge of the CPU.

8. The jig for orientating a CPU of claim 1, wherein the elastic portion is an U-shaped elastic slice, a first end of the elastic portion is formed on an inner wall of the opening, and a second end of the elastic portion is extended from the inner wall of the opening.

9. The jig for orientating a CPU of claim 8, wherein the elastic portion comprises a limiting-protrusion extruded from a surface of the second end of the elastic portion, and a distance between the limiting-protrusion and the limiting portion is greater than or equal to a thickness of the edge of the CPU.

* * * * *